US006145568A

United States Patent [19]

Lundström

[11] Patent Number: 6,145,568

[45] Date of Patent: Nov. 14, 2000

[54] OBJECT MANEUVERING ARRANGEMENT

[75] Inventor: Lars Birger Lundström, Skellefteå, Sweden

[73] Assignee: Megadoor AB, Sweden

[21] Appl. No.: 09/186,891

[22] Filed: Nov. 6, 1998

Related U.S. Application Data

[63] Continuation of application No. PCT/SE97/00761, May 7, 1996.

[30] Foreign Application Priority Data

May 7, 1996 [SE] Sweden ..... 9601733

[51] Int. Cl.[7] ..... A47H 5/00

[52] U.S. Cl. ..... 160/84.02; 160/189; 160/265; 49/200

[58] Field of Search ..... 160/84.01, 84.02, 160/84.04, 85.05, 35, 1, 7, 85.06, 107, 118, 150, 188, 189, 168.1 R, 370–23, 405; 49/200

[56] References Cited

U.S. PATENT DOCUMENTS

| | | | |
|---|---|---|---|
| 4,673,018 | 6/1987 | Judkins | 160/84.2 X |
| 4,811,777 | 3/1989 | Chretien | 160/189 X |
| 4,997,022 | 3/1991 | Klein | 160/265 |
| 5,082,043 | 1/1992 | Moreno | 160/84.02 X |
| 5,159,967 | 11/1992 | Ashley et al. | 160/265 |
| 5,170,108 | 12/1992 | Peterson et al. | 160/84.02 X |
| 5,179,989 | 1/1993 | Schon | 160/84.02 |
| 5,205,070 | 4/1993 | Lundstrom | 160/189 X |
| 5,222,541 | 6/1993 | Hornberger | 160/265 |
| 5,515,898 | 5/1996 | Alcocer | 160/84.02 |

FOREIGN PATENT DOCUMENTS

| | | |
|---|---|---|
| 4669923 | 4/1992 | Sweden . |
| 545906 | 2/1974 | Switzerland . |
| WO97/42391 | 11/1997 | WIPO . |

*Primary Examiner*—Daniel P. Stodola
*Assistant Examiner*—Bruce A. Lev
*Attorney, Agent, or Firm*—Smith, Gambrell & Russell, LLP

[57] ABSTRACT

A door maneuvering arrangement for opening and closing a door. The arrangement includes a line loop connected to a part of the door, a drive wheel, a motor for reversibly rotating the drive wheel and a plurality of guide pulleys for guiding the line loop. First guide pulleys are mounted in the vicinity of the drive wheel and cause a first line section of the line loop to bear on and extend in an omega-shape path around a first portion of the circumference of the drive wheel. Second guide pulleys are mounted in the vicinity of the drive wheel and caused a second line section of the line loop to bear on and extend in an omega-shape path around a second portion of the circumference of the drive wheel.

6 Claims, 3 Drawing Sheets

OBJECT MANEUVERING ARRANGEMENT

This application is a continuation of PCT/SE97/00761 having an international filing date of May 7, 1996. PCT patent application Ser. No. PCT/SE97/00761 is incorporated herein by reference.

BACKGROUND OF THE INVENTION

1. Field of the Invention

The present invention relates to an object maneuvering arrangement, for instance an arrangement for maneuvering a door or like device.

2. Description of The Prior Art

With regard, for instance, to doors that are comprised of one or two flexible fabric door panels that can be raised and lowered in the manner of a curtain or a folding door with the aid, for instance, of lines in co-action with a bottom beam carried by the fabric door panel or panels, there is a significant need of a technically and economically attractive maneuvering arrangement.

SUMMARY OF THE INVENTION

Listed below are a number of advantages that are afforded by the invention.

The inventive maneuvering arrangement is of particularly simple construction and has a very long useful life with regard to its technical aspects. The maneuvering arrangement is also highly reliable in operation and can be used in conjunction with many different types of door constructions, and also in a number of other contexts in which an object is required to be moved vertically. Synchronism in movement between the two side edges of the door is ensured. The door is raised and lowered smoothly. A force limitation is implemented automatically in the event of unexpected disturbances, through the medium of a slipping action. Slipping between drive line and drive wheel does not affect the simple monitoring carried out by pulse emitters or inductive sensors. The invention enables opening and closing of the door to be monitored reliably and safely. The inventive arrangement has both technical and economical advantages.

BRIEF DESCRIPTION OF THE DRAWINGS

The invention will now be described in more detail with reference to an exemplifying embodiment thereof and also with reference to the accompanying drawings, in which.

DETAILED DESCRIPTION OF THE INVENTION

Figure 1:
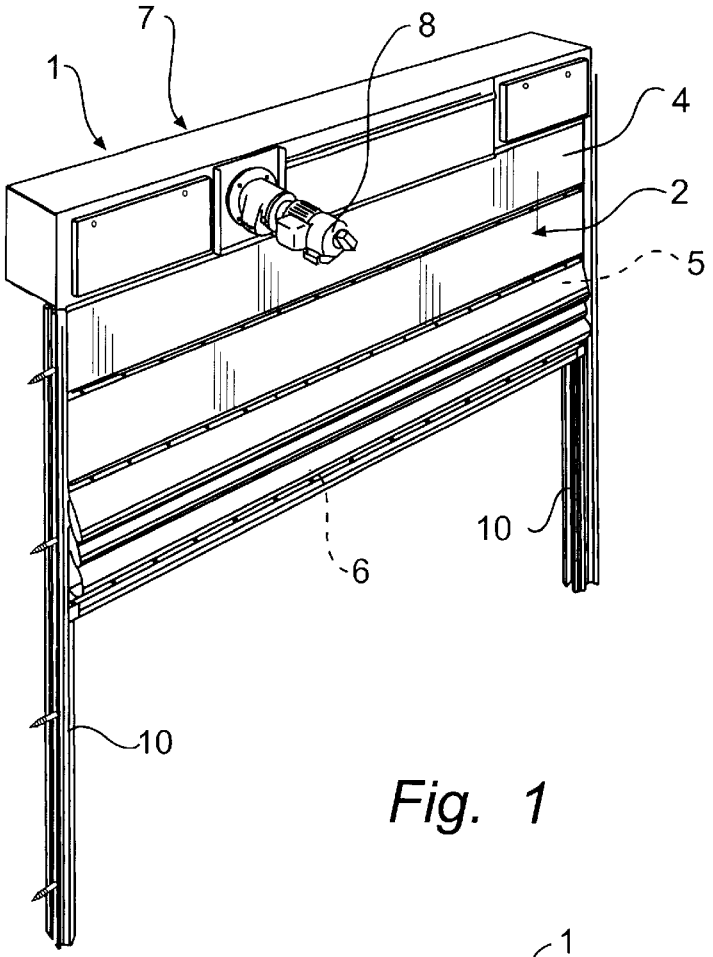
FIG. 1 is a perspective view of a curtain-like door structure and shows the door half open.
Figure 2:
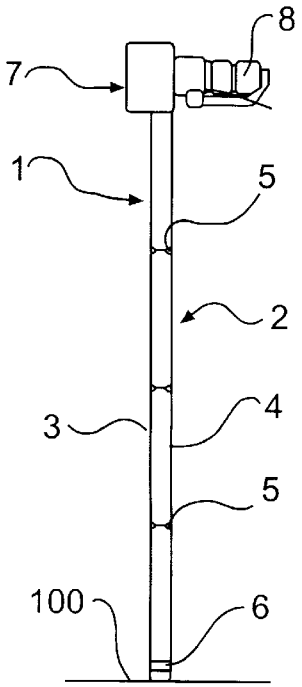
FIG. 2 is a schematic cross-sectional view of the door structure shown in FIG. 1 with the door closed.
Figure 3:
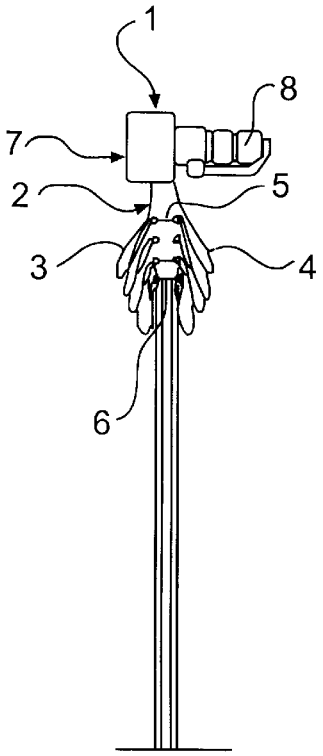
FIG. 3 is a schematic cross-sectional view of the door structure shown in FIG. 1, with the door open.

The curtain-like door structure 1 shown in FIGS. 1–3 comprises a door 2 which includes two flexible fabric door panels 3,4, which may be reinforced plastic structures, and a variable number of bars or profile elements 5, for instance aluminum profiles, that extend transversely between said door panels 3 and 4 and are anchored thereto. The fabric door panels 3 and 4 carry a bottom beam 6, for instance an aluminum beam, at their bottom edges. The upper edges of respective fabric door panels 3 and 4 are fastened to a box 7 which houses the requisite machinery, hereinafter referred to as the machine box 7, including a door maneuvering drive motor 8 among other things. The machine box 7 is secured to the upper edge of a door opening so that when the door 2 is lowered it will cover the door opening with the bottom beam 6 lying against a floor surface 100 or corresponding surface. Side bars/guide rails 10 are fastened to the side edges of the door opening. The ends of the transverse profiles 5 and the bottom beam 6 are able to slide relative to the side rails 10 and are guided therein.

Maneuvering of the door structure 1, i.e. raising and lowering of the door 2, is normally achieved with the aid of two lines, wires, cables, or bands which communicate with a wind-up drum or the like through the medium of guide rollers, said drum being rotated by the drive motor 8. FIG. 2 shows the door when fully closed, i.e. with the door panels lowered to their fullest extent, while FIG. 3 shows the door fully open, i.e. with the door panels raised to their fullest extent.

It will be understood that the door structure 1 includes the necessary sealing arrangements and safety devices, although these arrangement and devices will not be described in any detail here.

The inventive maneuvering arrangement 20 will now be described in more detail with reference to FIGS. 4–8.

The drive motor/drive means 8, which may be an electric, reversible gear motor is suitably housed in the machine box 7. The drive shaft 21 of the drive device 8 carries a non-rotatably fixed drive pulley 31 that includes two circumferentially extending, V-shaped grooves 32,33 which receive a drive line.

The maneuvering arrangement 20 includes a holding device in the form of an oscillating holder or cradle 30. The holder 30 includes two end places 34,35 which are interconnected by means of spacer bolts 36–41. The holder/cradle 30 also includes the aforementioned drive wheel 31, the hub 48 of which is rotatably connected with the end plates 34,35 via two roller bearings 49, wherein the outer races of said bearings 49 carry the end plates 34,35 and the inner races of said bearings are carried by the hub 48. The holder 30 also includes two upper guide pulleys 42,43 and two lower guide pulleys 44,45. The guide pulley 42 is rotatably carried by the spacer bolt 38. The guide pulley 43 is rotatably carried by the spacer bolt 39. The guide pulleys 44 and 45 are rotatably carried by respective spacer bolts 40 and 41.

Each of the pulleys 42–45 has a circumferentially extending drive-line receiving guide groove 46. The upper pulley 42 and 43 are positioned so that their respective guide grooves 46 are located essentially in the same plane as the line groove 32 on the drive wheel 31. The lower guide pulleys 44 and 45 are positioned so that their respective guide grooves 46 are located essentially in the same plane as the line groove 33 on the drive wheel 31. This will best be seen from FIG. 7. It will be noted that the guide pulleys 42–45 are distanced from the drive wheel 31 by an extent which will at least enable the drive line to run freely and non-squeezed between the guide pulleys and the drive wheel, as evident from FIGS. 4–6 for instance.

The drive motor 8 housed in the machine box 7 carries for drive wheel 31 on its drive shaft 21, and thus the entire cradle/holder 38. The holder 30 is able to awing between two stop members 55,56 mounted on the machine box 7. Thus, the holder 30 will either lie against the stop member 55 or the stop member 56, depending on the direction of rotation of the drive motor 8. The holder/cradle 30 pivots about its centre line 47, as indicated by the double arrow C, such that edge part 53 of one of the end plates 34,35 will make contact with the stop member 55, or an edge part 54 of one of the end plates 34,35 will make contact with the stop member 56.

Figure 4:
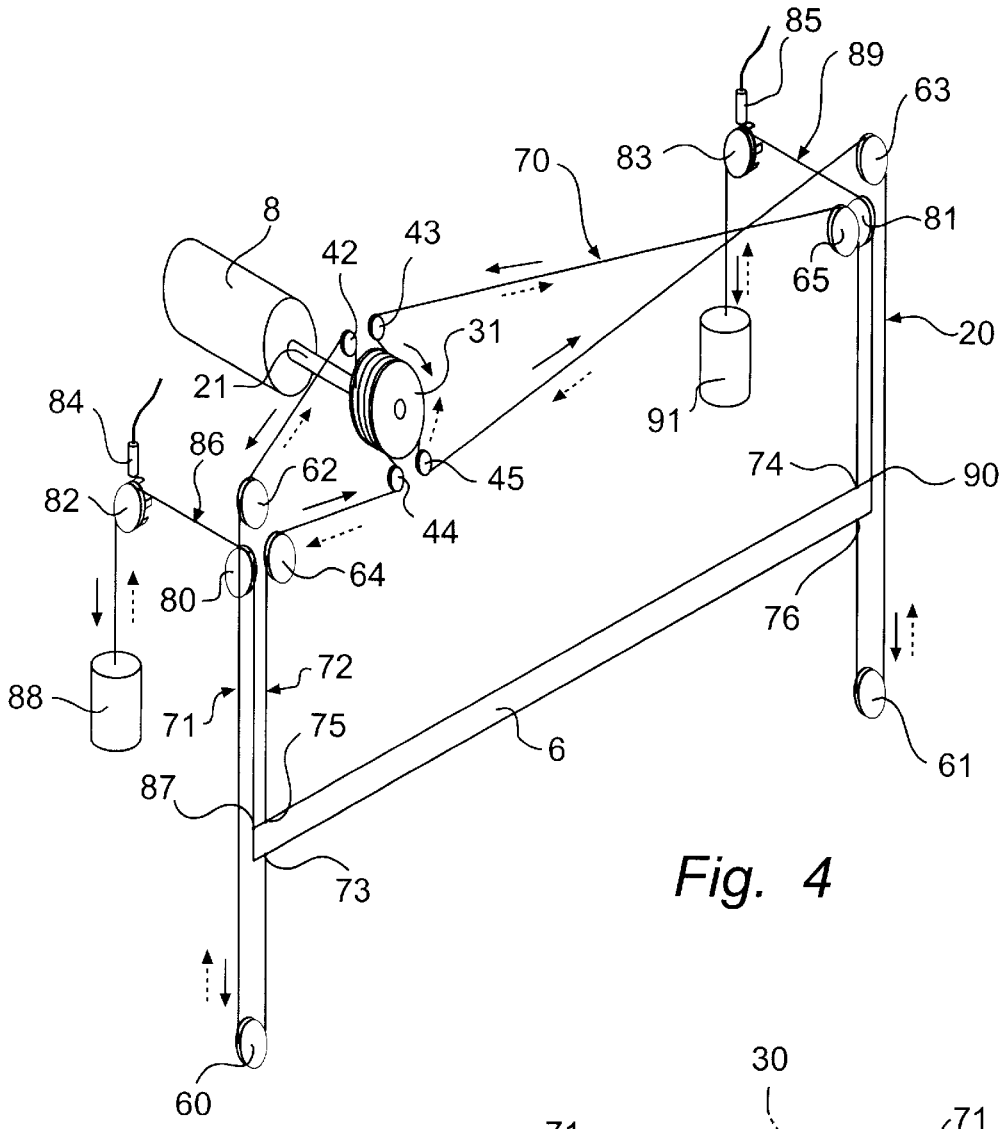
FIG. 4 is a schematic perspective view of the inventive maneuvering arrangement exposed to the viewer.

The bottom beam 6 is shown schematically in FIG. 4. Fitted to the bottom end of the side rails 10 is a respective grooved and rotatable guide pulley 60,61. Two upper grooved and rotatable guide pulleys 62 and 63 are mounted at respective end parts of the machine box 7. Two lower, grooved and rotatable guide pulleys 64 and 65 are mounted on respective end parts of the machine box 7.

The arrangement includes a line loop 70 which functionally can be considered as being divided into a first and a second part-loop 71 and 72, said loop extending in the pattern described below.

The first part-loop 71 runs downwards from a first attachment point 73 at a first end of the bottom beam 6 and is then diverted by the guide pulley 60 so that the line runs upwards and is then diverted inwards towards the holder 30 by the guide pulley 62, wherewith the line is diverted by the guide pulley 42 and thereafter passes preferably around at least half the circumference of the drive wheel 31 in the groove 32 in an omega-shaped path, and is then diverted by the guide pulley 43 outwards towards the guide pulley 65, so that the line runs downwards to a second attachment point 74 at the other end of the bottom beam 6.

The second part-loop 72 runs upwards from a first attachment point 75 at the first end of the bottom beam 6 and the line is then diverted by the guide pulley 64 inwardly towards the holder 30 and is then diverted by the guide pulley 44 into the groove 33 of the drive wheel 31 and passes preferably around at least half the circumference of the drive wheel in an omega-shaped path, whereafter the line is diverted by the guide pulley 45 outwards towards the guide pulley 63 which guides the line downwards towards the guide pulley 61, which diverts the line upwards to a second attachment point 76 at the second end of the bottom beam 6.

Figure 5:
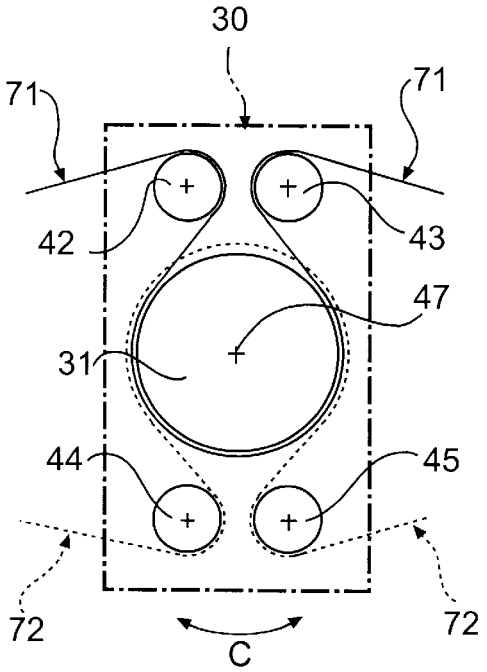
FIG. 5 illustrates schematically and more clearly the "omega"-like path traveled by the line through a holder carried by the drive wheel.
Figure 6:
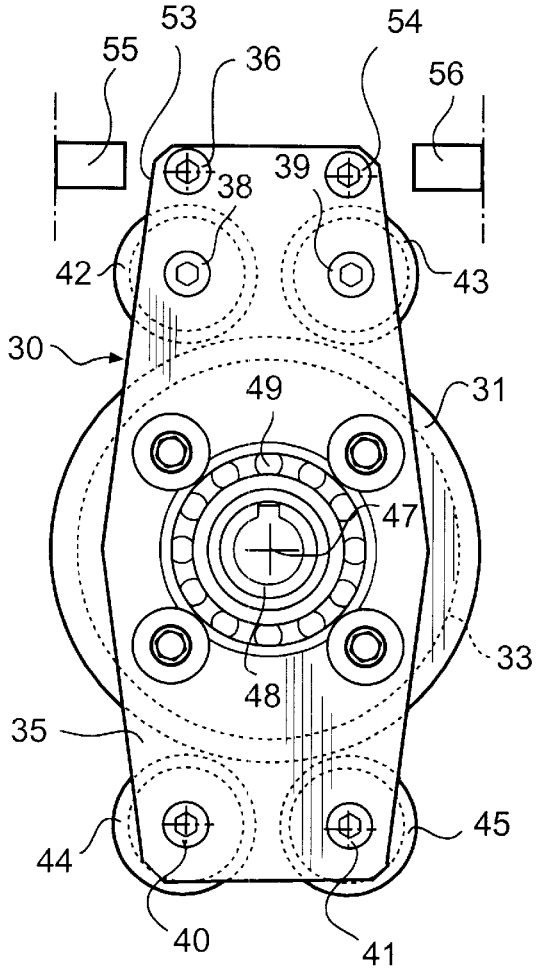
FIG. 6 is a front view of the holder.
Figure 7:
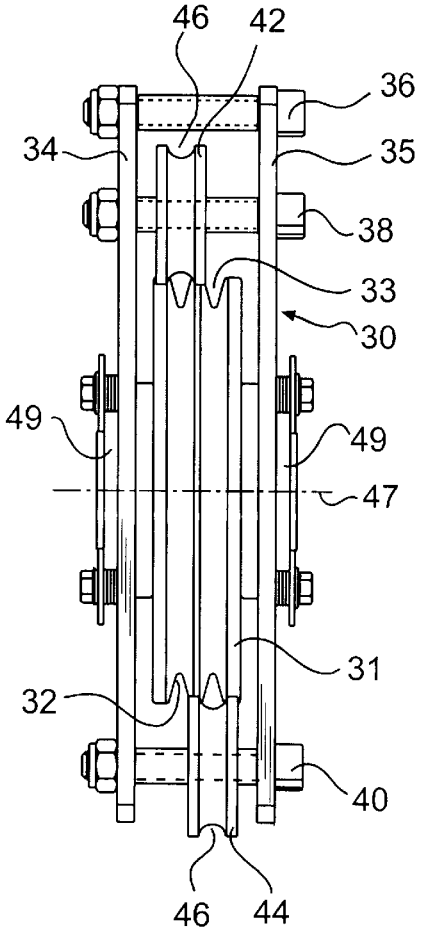
FIG. 7 is a side view of the holder.
Figure 8:
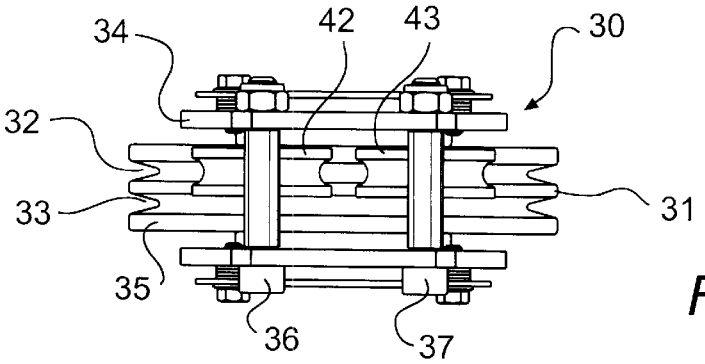
FIG. 8 shows the holder from above.

The omega-shaped rungs of the two part-loops 71 and 72 in the holder 30 are illustrated schematically in FIG. 5 for the sake of clarity.

It has been found advantageous to use, for instance, a polymeric fiber line, such as a polyester line for instance. It will be understood, however, that other types of lines, hands or wires, cables etc., can be used within the scope of the invention.

A grooved and rotatable first guide pulley 80 and 81 is for example mounted on respective end-parts of the machine box 7 in the upper region of the door structure 1. A grooved and rotatable second guide pulley 82 and 82 is mounted on respective end-parts of the machine box 7. The guide pulleys 82 and 83 are also provided with teeth or otherwise configured for co-action with a detector element 84 and 85 which continuously detects, or senses, the position and direction of movement of the door 2 and monitors functioning of the lines and their status, etc.

A counterweight carrying first line 86 runs upwards from a first attachment point 87 at the first end of the bottom beam 6 and is then guided downwards by the guide pulleys 80 and 82, the other end of the line 86 carrying a counterweight 88.

A counterweight-carrying second line 89 runs upwards from a second attachment point 90 at the second end of the bottom beam 6 and is then guided downwards by the guide pulleys 81 and 83, said line 89 carrying a counterweight 91 at its other end.

Although not shown, each of the counterweights 88 and 91 is preferably disposed in individual channeling or tubing. The purpose of the counterweights is to balance-out the weight of the door 2 at lest partially, so as to reduce the necessary power output of the drive motor O in maneuvering the door. The use of counterweights that balance out the weight of the door will eliminate the risk of the door falling abruptly in the event of a line breakage. The counterweights also facilitate manual emergency maneuvering of the door. The lines 96 and 89 may, for instance, be made of steel or a polymeric fibre. Bands or straps may also be used, of course.

The door is opened in the following way. The drive motor 8 is actuated to drive the drive wheel 31 in the direction of the arrow A (clockwise), causing the line to move in the directions shown by the solid arrows in FIG. 4, when the bottom beam 6 has reached its upper end position, in which the door is fully open, the indicating elements, or sensors, 84 and 85 cause the drive motor 8 to stop, in co-action with a control system. Because the drive motor 8 is rotated in the direction of the arrow A, the holder 30 will swing about its centre line 47 in a direction towards the stop member 56, so that non-pulling line sections are pulled taut and therewith ensure full abutment of the line with the drive wheel 31.

The door is closed in the following way. The drive motor 8 is actuated to rotate the drive wheel 31 in the direction of arrow D (anticlockwise), resulting in line movement in the directions marked with broken arrows in FIG. 4. When the bottom beam 6 reaches its bottom end position, in which the door is fully closed, the indicating elements, or sensors 84 and 85, cause rotation of the drive motor 8 to stop, in co-action with a control system. When the drive motor 8 rotates in the direction of arrow B, the holder 30 will swing about its centre line 47 into engagement with the stop member 55, so that non-pulling line sections will be pulled taut and therewith ensure full abutment of the line with the drive wheel 31.

It will be understood that the invention is not restricted to the aforedescribed and illustrated components, and that these components can be replaced with functionally equivalent components within the scope of the invention.

The positioning and mounting of the guide pulleys may also be varied within the scope of the invention. The lines may be replaced with wires, bands or straps for instance.

It will also be understood that the inventive maneuvering arrangement can be used to vertically maneuver objects other than doors. Advertising boarding, panelling, curtains, etc. are non-limiting examples of other uses of the inventive maneuvering arrangement.

It will also be understood that the inventive maneuvering arrangement can be adapted for maneuvering and operating objects in non-vertical movement directions by simple modifications to the arrangement.

The invention shall not therefore be considered to be limited to the illustrated and described embodiment, since changes and modifications are possible within the scope of the following claims.

What is claimed is:

1. A door maneuvering arrangement, comprising:

a plurality of separate part loops adapted to be connected to opposing parts of a door;

a drive wheel;

means for reversible rotation of the drive wheel;

a plurality of guide pulleys including first guide pulleys and second guide pulleys for guiding the plurality of part loops;

said first guide pulleys being mounted in the vicinity of the drive wheel and causing a first part loop to bear on and extend in an omega-shaped path around a first portion of the circumference of the drive wheel; and said second guide pulleys being mounted in the vicinity of the drive wheel and causing a second part loop to bear on and extend in an omega-shaped path around a second portion of the circumference of the drive wheel.

2. An arrangement according to claim 1, characterized in that the first part loop (71) and the second part loop (72) are in contact with the drive wheel (31) on diametrically opposite sides thereof; and in that the drive wheel (31) includes a first groove (32) which receives the first part loop (71) and a second groove (33) which receives the second part loop (72).

3. An arrangement according to claim 1, characterized in that the drive wheel (31) and said first and second guide pulleys (42–45) are mounted in a common holder (30) which is supported by a drive shaft (21) of said means for reversible rotation of the drive wheel (8).

4. An arrangement according to claim 3, characterized in that the holder (30) is pivotally mounted (C) between two stop members (55,56).

5. An arrangement according to claim 1, characterized by counterweights (88,91) for reducing the power requirement of the drive means (8).

6. An arrangement according to claim 1, characterized by means (84,85) for indicating the position of the door.

* * * * *